US011400612B2

(12) United States Patent
Papenfuss

(10) Patent No.: US 11,400,612 B2
(45) Date of Patent: Aug. 2, 2022

(54) ROTARY CUTTER WITH INTERCHANGEABLE BLADE

(71) Applicant: William Prym GmbH &Co. KG, Stolberg (DE)

(72) Inventor: Andreas Papenfuss, Weimar (DE)

(73) Assignee: William Prym GmbH & Co. KG, Stolberg (DE)

( * ) Notice: Subject to any disclaimer, the term of this patent is extended or adjusted under 35 U.S.C. 154(b) by 121 days.

(21) Appl. No.: 16/947,344

(22) Filed: Jul. 29, 2020

(65) Prior Publication Data

US 2021/0031392 A1 Feb. 4, 2021

(30) Foreign Application Priority Data

Jul. 29, 2019 (DE) ..... 20 2019 104 152.8

(51) Int. Cl.
*B26B 25/00* (2006.01)
*B26B 29/06* (2006.01)
*B25G 1/10* (2006.01)

(52) U.S. Cl.
CPC ..... *B26B 25/005* (2013.01); *B25G 1/102* (2013.01); *B26B 29/06* (2013.01)

(58) Field of Classification Search
None
See application file for complete search history.

(56) References Cited

U.S. PATENT DOCUMENTS 2,695,447 A 11/1954 Todd
5,144,749 A 9/1992 Chen
5,299,355 A * 4/1994 Boda ..... B26B 5/003 30/162
5,765,289 A 6/1998 Cornell
6,282,794 B1 9/2001 Cho
6,438,850 B2 8/2002 Young
6,484,405 B1 11/2002 Martelli
7,363,710 B2 4/2008 Heiberg
7,434,319 B2 * 10/2008 Tsai-Lian ..... B26B 25/005 30/164.95
8,046,922 B2 11/2011 Eby
D756,190 S * 5/2016 Pirayesh ..... D8/98
D931,702 S * 9/2021 Papenfuss ..... D8/98
2005/0086811 A1 * 4/2005 Kawasaki ..... B26B 29/00 30/162
2006/0236551 A1 * 10/2006 Chang ..... B26B 25/005 30/319
2010/0236076 A1 * 9/2010 Votolato ..... B26B 29/02 30/151

(Continued)

FOREIGN PATENT DOCUMENTS

DE 3516726 C1 8/1986
DE 20021142 U1 3/2001

(Continued)

*Primary Examiner* — Hwei-Siu G Payer

(74) *Attorney, Agent, or Firm* — Oppedahl Patent Law Firm LLC

(57) ABSTRACT

The invention relates to a rotary cutter (10) with an exchangeable blade (33), which enables the blade (33) to be replaced easily with little risk of injury and can be used in a variety of ways. The rotary cutter (10) comprises a handle (20) and a blade holder (30) which is detachably connected to the handle (20). A solid casing of the blade holder (30) takes at least half of the blade (33) within it (FIG. 1).

23 Claims, 3 Drawing Sheets

(56) References Cited

U.S. PATENT DOCUMENTS

| | | | | |
|---|---|---|---|---|
| 2013/0283622 | A1 | 10/2013 | Eto | |
| 2015/0266193 | A1 | 9/2015 | Bell | |
| 2016/0193741 | A1 | 7/2016 | Wong | |
| 2017/0297214 | A1 | 10/2017 | Liu | |
| 2019/0240853 | A1* | 8/2019 | Mortensen | B26B 21/185 |
| 2021/0031392 | A1* | 2/2021 | Papenfuss | B26B 29/06 |

FOREIGN PATENT DOCUMENTS

| | | | |
|---|---|---|---|
| EP | 1878546 | A1 | 1/2008 |
| EP | 1525959 | B1 | 9/2010 |
| EP | 3 771 534 | A1 * | 2/2021 |
| RU | 2238843 | C1 | 10/2004 |
| WO | WO2000/007783 | A1 | 2/2000 |
| WO | WO2009/091697 | A2 | 7/2009 |

* cited by examiner

ROTARY CUTTER WITH INTERCHANGEABLE BLADE

The invention relates to a rotary cutter with a replaceable blade.

BACKGROUND

Rotary cutters are used for cutting different materials, in particular for cutting textile materials for example for hand-made garments. Such hand-held rotary cutters typically comprise a handle and a round blade arranged on the handle. Roll cutters with interchangeable blades are already known, for example from documents U.S. Pat. No. 6,438,850B2, U.S. Pat. No. 5,144,749A, WO2009/091697A2 and EP1525959B1. All known rotary cutters have the disadvantage that contact with the edge of the blade is possible when changing the blade and there is therefore a risk of injury.

An aim of the present invention is to provide an improved rotary cutter with an exchangeable blade, which enables the blade to be replaced easily with little risk of injury, and can be used in a variety of ways.

SUMMARY OF THE INVENTION

This aim is achieved with a rotary cutter with the features of claim 1. The dependent claims contain further advantageous features for such a device.

This new rotary cutter with interchangeable blade has a handle for the user of the rotary cutter. At one end of the handle, termed the holding area, the handle is connected to a blade holder which comprises a blade. The connection between the handle and the blade holder can be released, which enables the blade stored in the blade holder to be changed. In this case, the blade holder represents a solid sleeve for the blade and accommodates at least half of the blade in the receiving space of this sleeve. The shape of the fixed sheath of the blade holder is chosen so that the blade is arranged between two semicircular side walls of the sheath and these semicircular side walls cover the blade on both sides. The blade edge is protected in this covered area by the curved outer wall of the sheath of the blade holder. The course of the outer wall is adapted to the radial course of the blade edge, so that on the one hand the blade mounted in the blade holder can be freely rotated about its axis of rotation without touching the outer wall, and on the other hand the smallest possible size for the blade holder can be selected. For the rotatable mounting of the blade, a bearing bushing is provided on each of the two side walls of the blade holder in the area around the axis of rotation of the blade. The blade has a slide bearing in the center, which engages on both sides with a respective cylinder protruding over the blade surface in the respective bearing bush of the side walls of the blade holder.

It is particularly advantageous that the blade holder itself is also rotatably mounted on the handle around the same axis of rotation. The rotary movement of the blade holder is limited here, namely between two rotational end positions. In the first rotational end position—the securing position—the sleeve of the blade holder is outside the handle and thus covers the blade to the outside. This prevents injuries to the blade edge in this securing position, which is assumed during assembly and when the rotary cutter is not being used. In the second end of rotation position—the working position—the blade holder is rotated into the handle, whereby the blade protrudes from the handle and a sufficiently large portion of the circumference of the blade edge is exposed for a desired use. The rotary movement of the blade holder is made possible by a corresponding guide on the handle, namely a guide running in a semicircle around the common axis of rotation of the blade and the blade holder. This guide is arranged in an area on the rear wall of the handle which is extended beyond the handle area. This area represents the holding area. The guide is provided as a recess in the rear wall. A rotary knob of the blade holder engages in this guide and protrudes outwards from a side wall of the blade holder.

The aforementioned rotary end positions of the blade holder can ensure that the rotary knob is held securely in the respective rotary end position by the provision of clamping or fixing elements.

The blade holder is mounted on one end of the handle as described above. For this purpose, the rear wall has a hole in the holding area for a pivot pin which passes through the bearing bushes of the blade holder. In one embodiment, a screw is advantageously used as the connecting means between the handle and the blade holder, which runs along the axis of rotation of the blade and the blade holder through the rotary cutter and also assumes the function of a pivot pin.

In a particularly advantageous embodiment, the blade holder is arranged between the rear wall of the handle and a cover connected to the handle. This cover is connected to the handle, for example, by means of the same screw which serves to connect the blade holder and the handle. For this purpose, the cover has on its inner surface facing the handle a threaded sleeve which interacts with a thread which is provided on the end of the shaft of the screw. The screw can also reach through the cover and be connected to an additional nut on the outside.

The cover also advantageously has a recess in the form of a semicircular guide, comparable to that on the rear wall of the handle. The two guides have the same shape and size. The width of the guides is adapted to the diameter of the rotary knobs so that they can be easily moved along the guides from one end of rotation position to the other end of rotation position. Both guides are arranged parallel to each other and at the same distance from the axis of rotation. Another knob on the blade holder engages in the guide in the cover. Both knobs are arranged on the blade holder so that they are the same size and have the same central axis. They each point outwards, on the one hand from the front side wall to the front and on the other hand from the rear side wall of the blade holder to the rear. The two-sided guidance of the blade holder by means of the two rotary knobs in the two semicircular guides ensures an even support of the blade holder and a safe movement of the blade while working.

The blades of this new rotary cutter can also be exchanged in an advantageous manner. To do this, the blade holder is released from the handle. In the case when the blade holder is connected by means of a screw on the handle, this screw is loosened and a unit comprising the blade holder with the blade is removed from the handle. The removal takes place in the securing position of the blade holder, so that the user can grip the blade holder on the side surfaces of the fixed casing and without touching the blade, in particular the blade edge, remove the blade holder with the blade and in the same way a unit consisting of a blade holder and one new blade. It is not necessary to touch the edge of the blade during assembly, so that the user is protected from injury. In addition, the blade holder protects the blades—even when stored outside the rotary cutter—against dulling, and this prevents damage to work materials.

The detachable connection between the handle and the blade holder advantageously consists of a screw connection.

The screw runs along the axis of rotation, rests with the screw head on the rear wall of the handle, passes through the hole on this rear wall, the bearing bushes of the blade holder and the slide bearing of the blade and is connected at the other end, for example, to the threaded sleeve on the inside of the cover. With a simpler version, e.g. without a cover, the use of a nut is also possible.

It is particularly advantageous in the case of the rotary cutter that the tool for the connection or connection solution between the handle and the blade holder, e.g. a screwing tool is arranged. For this purpose, there is a recess in the handle area of the handle, in particular a handle that extends through the handle and in which the tool is held. The tool can therefore be easily inserted or removed from both sides. The head of the tool is adapted to the shape of the recess, so that a positive fit is realized. In addition, fixing elements can be provided in the recess and on the tool for a secure hold of the tool.

In addition, the new rotary cutter has a shape that is comfortable for the user. In one embodiment, the handle is formed from two plastic shells, the front shell leaving the holding area of the blade holder free and the rear wall of the rear shell extending into this holding area. In addition, at least one upper part and one lower part made of softer plastic are provided in this advantageous embodiment. The upper part and lower part can also encompass the holding area of the handle in one piece. The upper and lower part are ergonomically designed so that the rotary cutter lies well in the user's hand when working. The ergonomic shape of the handle allows comfortable use in different handle positions.

This new ergonomic rotary cutter advantageously contains the function of the safe blade change. Blade holder and blade form a unit to be assembled and disassembled, so that each blade is provided with a blade guard. Different blades can be used with the rotary cutter for different separating cuts. For example, a blade holder with a round blade with a flat blade blade is used for a straight separating cut, round blades with corrugated blade blade are used for ZigZag separation lines and round blades with teeth on the peripheral edge of the blade blade for perforation lines.

The different blades with a comparable outer diameter advantageously form a unit with a blade holder of the same size. For better differentiation, these blade holders can be designed in different colors. The units, e.g. stored in a plug-in container, together with the rotary cutter form a rotary cutter set.

It is advantageous that the blade, which is clearly visible in the working position, makes precise work easier. In addition, the new rotary cutter can be operated equally well by left-handed and right-handed users by providing two knobs. The ergonomic shape of the handle makes it comfortable to use. Separating cuts and turning the blade holder from one end position to the other are easy to do with one hand.

Further measures and advantages of the invention are set out in the description below. The invention is directed to all the new features evident therefrom.

DETAILED DESCRIPTION

Figure 1:
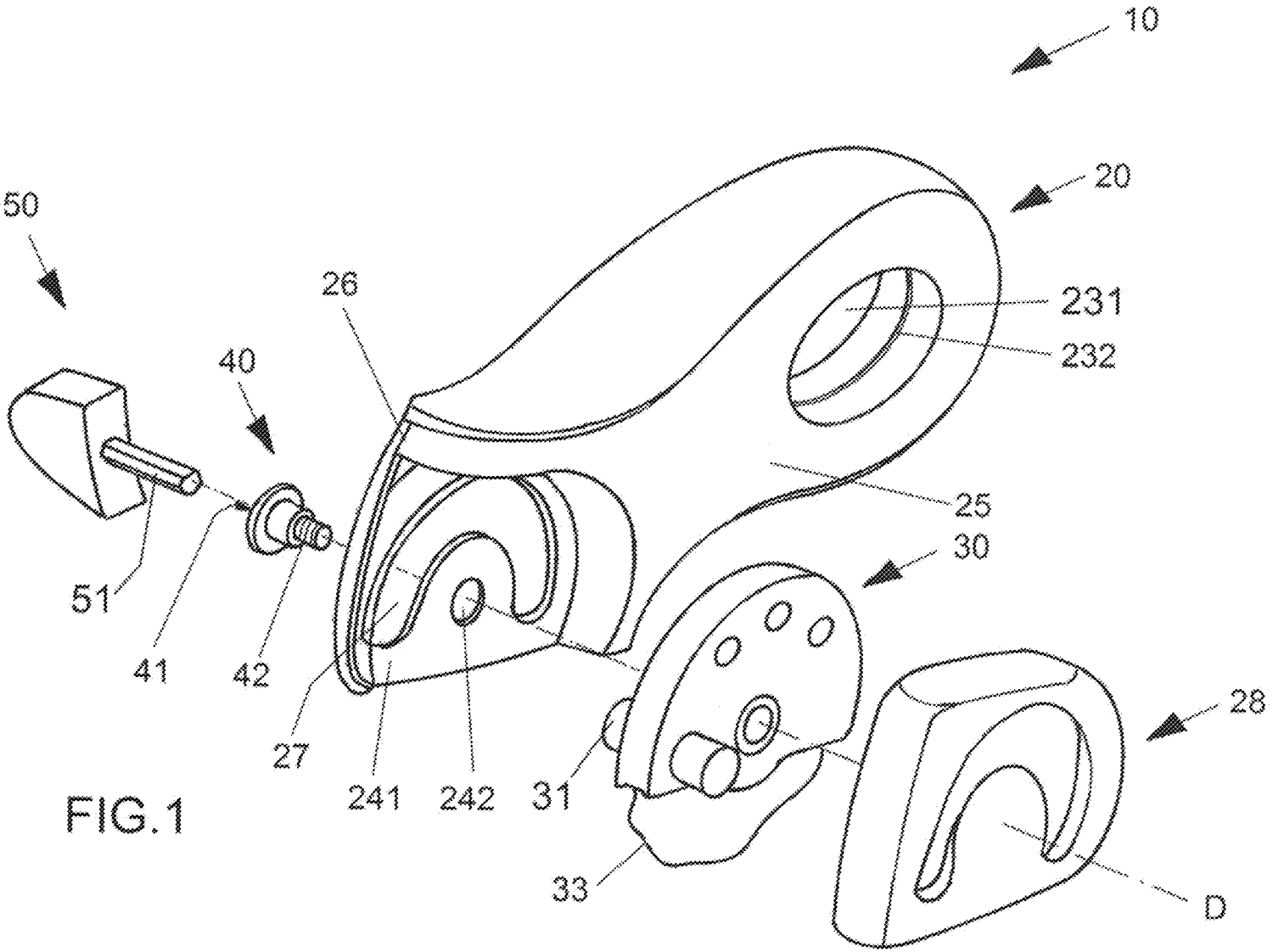
FIG. 1 is a perspective view of the individual parts of a rotary cutter before assembly of the blade holder.
Figure 2:
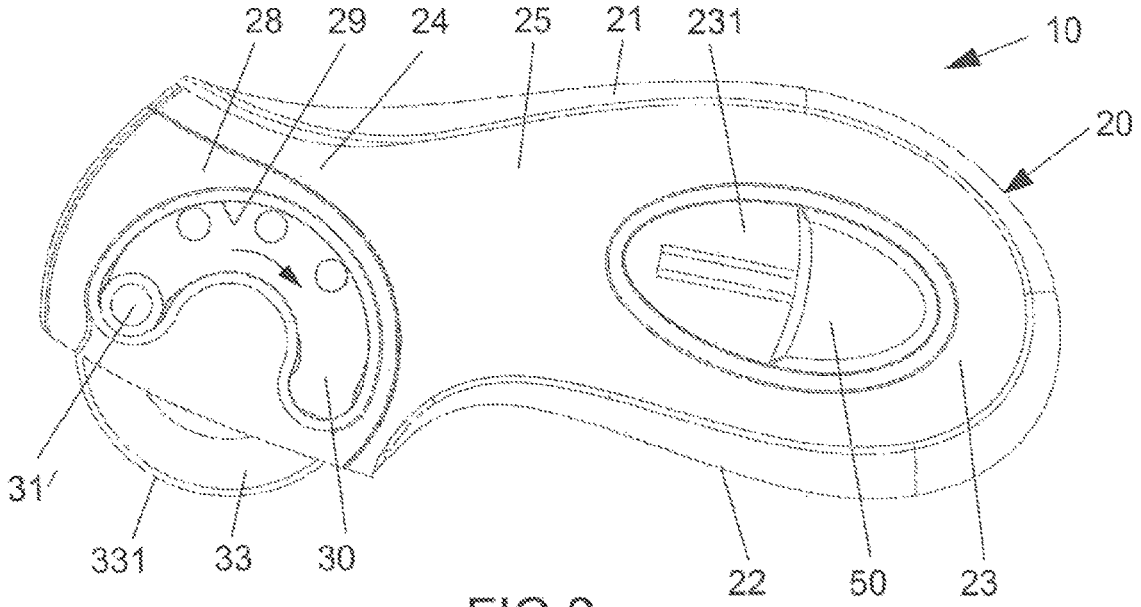
FIG. 2 is a front view of the assembled rotary cutter of FIG. 1 in the working position.
Figure 3:
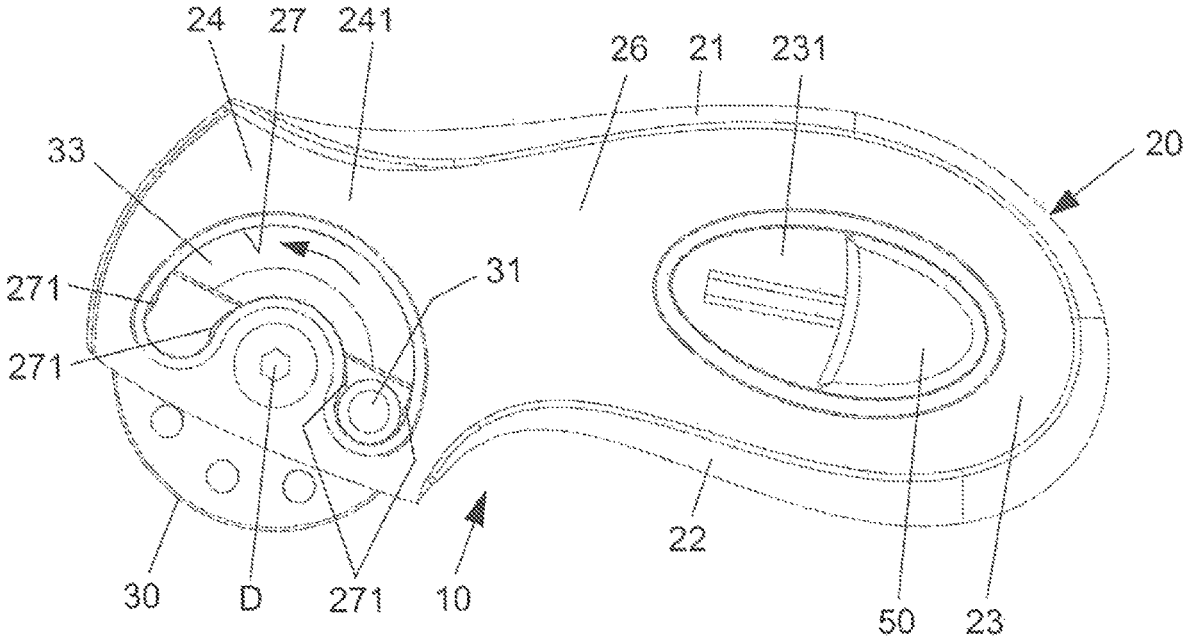
FIG. 3 is a rear view of the assembled rotary cutter from FIG. 1 in the securing position.

The embodiment shown in FIGS. 1 to 3 shows a particularly advantageous rotary cutter 10. In the figure, the individual parts of the rotary cutter 10 are shown in exploded view, namely the handle 20, the blade holder 30, the cover 28, the connecting means 40 and that tool 50 for producing a screw connection.

The handle 20 in this case consists of two shells 25, 26 made of plastic, namely the front shell 25 and the rear shell 26, which together with the upper part 21 and the lower part 22 form the grip area 23 of the rotary cutter 10. The rear wall 241 of the shell 26 extends from this grip area 23, the right part of the handle 20 in FIGS. 1 to 3, into the holding area 24, the left part of the handle 20 shown. The blade holder 30 is placed on this rear wall 241 for assembly, inserted with its rear rotary knob 31 in a semicircular guide 27 and connected to the handle 20 via a screw connection. After assembly, the screw 40 shown runs along the axis of rotation D, about which the blade 33 and the blade holder 30 can be moved. To form the connection, the screw 40 is inserted into the bore 242 on the rear wall 241 of the rear shell 26 of the blade holder 30, and is inserted through the blade holder 30 and blade 33 until the end of the screw with its thread 42 on the front shows the blade holder 30. Then the cover 28 is placed on the blade holder 30. This cover 28 can optionally also be fixed to the rotary cutter 10 by clamping means. For the connection of the cover 28 to the handle 20, this cover 28 has on its inside a threaded sleeve which interacts with the thread 42 of the screw 40. The screw 40 has between the screw head and the thread 42 a central shaft area without thread, which acts as a pivot pin for the blade holder 30 and the blade 33. For easier assembly and connection formation, the tool 50 shown is present, which in this example has a shaft 51 with a hexagonal cross section. The screw head of the screw 40 has a corresponding driving profile, in this case an internal hexagon 41, shown in FIG. 1 or FIG. 3.

When changing the blade, the blade holder 30 is to be rotated into the securing position and can be gripped by the person to be used on its fixed casing, consisting of side walls 36, 37 and outer wall 38, and can be removed from the rotary cutter after loosening the screw connection and removing the cover 28. The blade holder 30 can be safely used, for example, in an insertion container 60, where unused blade holders 30', 30", 30'" are stored. To insert a new blade 33, a new unit comprising a blade holder 30' with a blade 33 is removed from the insertion container 60. The blade holder 30 is held on its fixed sheath by the person to be used and is thus inserted into the handle 20 without touching the blade edge 331. In this case, the blade 33 points upwards and, after being inserted in the holding area 24 of the handle 20, is already essentially covered by the handle 20. Then the cover 28 is put on and the screw connection is made by means of the tool 50. After assembly, a rotary cutter 10, shown in FIG. 3, namely in the locking position of the blade holder 30, is obtained. In an advantageous manner, any injury from the blade edge 331 of the blade 33 can thus be prevented when changing the blade. The rotary cutter 10 is shown in FIG. 3 with a view of the rear shell 26, which comprises the rear wall 241 extending into the holding area 24 with the guide 27 running in a semicircle around the axis of rotation D. The width of this guide 27 is adapted to the diameter of the rotary knob 31 protruding from the blade holder 30, so that it can be used in a simple manner from the securing position—shown in FIG. 3—to the working position—shown in FIG. 2—by movement in the direction of the arrow. Since the rotary knob 31 is an integral part of the fixed sheath of the blade holder 30, the sheath of the blade holder 30 is also carried along during this movement. After moving, the rotary knob 31 is again in a rotational end position, shown in FIG. 2, in this case at the left end of the guide 27 and the fixed sleeve of the blade holder 30 has moved about the axis of rotation D and is in the working position within the handle 20, namely arranged between the rear wall 241 and the cover 28 and covered by these. FIG. 2 shows the working position. The rotary cutter 10 is shown from its front, namely with a view of the front shell 25 and the cover 28. This cover 28 also has a semicircular guide 29 running around the axis of rotation D, which, after the cover 28 has been installed, runs parallel to the guide 27 the rear wall 241 of the handle 20 extends and has the same shape and size for the guide 27. A further rotary knob 31' engages in this guide 29, which protrudes outwards from the front side wall 37 of the blade holder 30. Both rotary knobs 31, 31' have the same central axis and move parallel within their guides 27, 29. In the respective rotary end positions, the rotary knobs 31, 31' are fixed by constrictions 271 of the guides 27, 29. However, they can be shifted from their rotational end positions 111 with one hand by applying little force. Since the rotary knobs 31, 31' are provided on both sides of the rotary cutter 10, their movement can be carried out easily in the same way by both right-handed and left-handed people.

Figure 4:
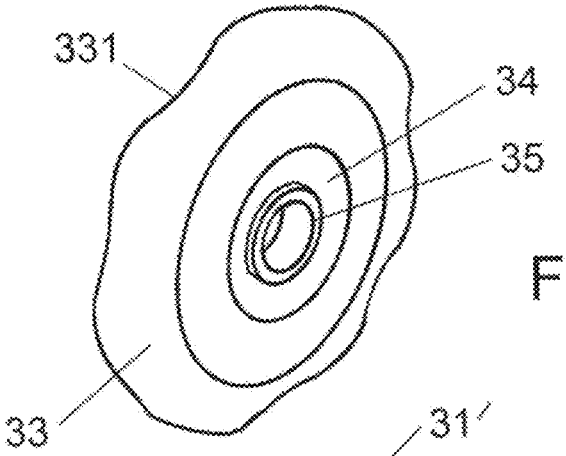
FIG. 4 is a perspective view of the blade holder of FIG. 1 before the blade is inserted.

In the example shown in the blade holder 30, a round blade 33 with a corrugated blade is rotatably held, so that when the rotary cutter 10 is used, the circumferential blade edge 331 can produce zig-zag-shaped separating cuts. As can be seen in FIG. 4, the blade 33 is held on the fixed sheath of the blade holder 30, consisting of two side walls 36, 37 and the outer wall 38 arranged around the blade edge 331, and is covered approximately halfway out through these walls 36, 37, 38. After assembly, the outer wall 38 is located at such a distance from the axis of rotation D that the blade 33 can easily be rotated in the working position. This distance is consequently somewhat larger than the diameter of the blade 33. Blade holder 30 and blade 33 are one unit in the new rotary cutter 10. The blade 33 is changed by changing the blade holder 30 in which the blade 33 is received. For the respective rotational movement of the blade 33 about the axis of rotation D, the blade 33 is provided with a slide bearing 34, which is injection-molded onto the metallic blade 33, for example, and comprises a cylinder 35 which projects outwards on both sides beyond the blade surface. With this cylinder 35, the blade 33 engages in the bearing bushes 32 of the blade holder 30, which are part of the side walls 36, 37, shown in FIG. 4. As described above, this preassembled unit is then inserted into the handle 20 and by means of the tool 50 the screw connection is made.

Figure 5:
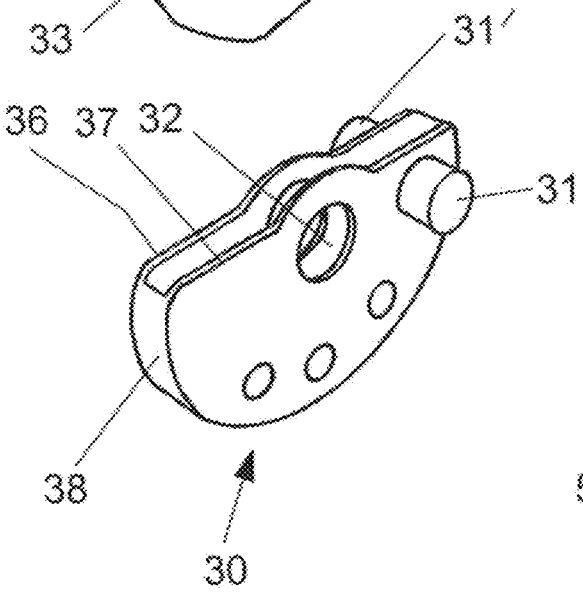
FIG. 5 is a perspective view of the tool of FIG. 1.
Figure 5:
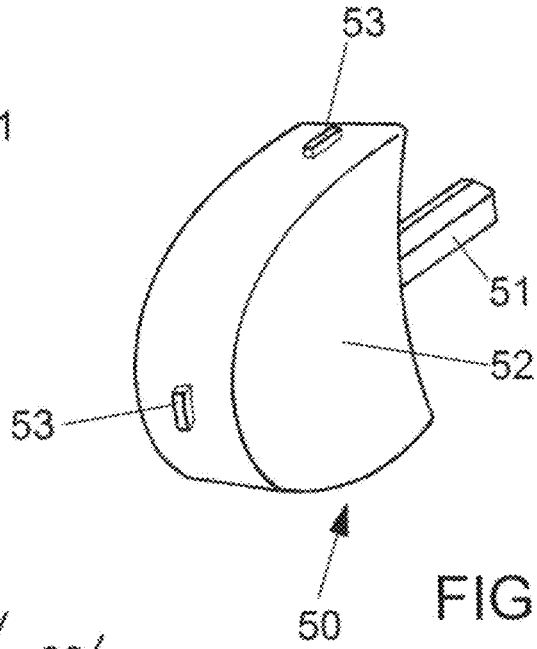
Figure 6:
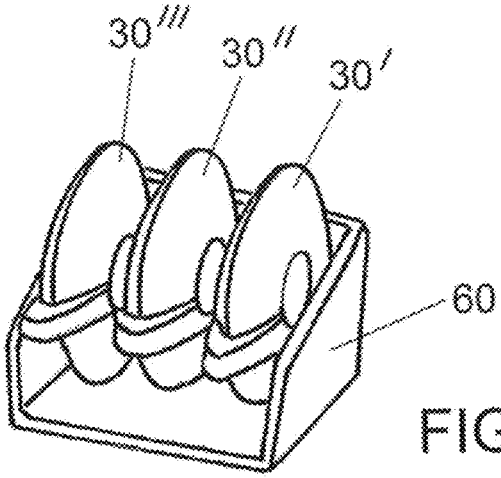
FIG. 6 is a perspective view of a filled plug-in container.

The tool 50 is always available with the new rotary cutter 10. It is namely held on the handle 20. The handle 20 has a recess 231 in the grip area 23, in which the tool 50 can be inserted. For this purpose, the tool head 52 is adapted to the shape of this recess 231. The length of the recess 231 is selected such that the shaft 51 can also be received. So that the tool 50 is held securely in this recess 231 when working with the rotary cutter 10, additional fixing elements are provided both on the tool head 52 and within the recess. In this example, the tool head 52 has tooth-like protruding fixing elements 53, shown in FIG. 5, which engage in a central groove 232 in the recess 231, shown in FIG. 1. The tool 50 can be easily pressed in one direction or the other from this fixing position by lateral pressure and is then available for a blade change.

The new rotary cutter 10 can be equipped with different blades, each of which is held in blade holders 30. A rotary cutter set includes, for example, in addition to the rotary cutter 10 shown with a blade 33 corrugated blade blade, also blade holder 30' with a blade with a flat blade blade for straight separating cuts, blade holder 30" with a blade with a serrated peripheral edge for perforation lines and a further blade holder 30" for another desired blade. The various blade holders 30', 30", 30" are advantageously stored in the insertion container 60 such that the blades 33 extend into the insertion container 60 and the blade holders 30', 30", 30'" point outwards. To change the blade, a desired unit can be securely gripped on the fixed shell of the respective blade holder 30', 30", 30" and inserted into the handle 20 without touching the blade. In order to facilitate the selection of the correct blade holder 30, 30", 30'" when changing the blade, the fixed sleeves of the blade holders 30', 30", 30'" with the different blades 33 are designed in different colors.

The rotary cutter 10 can be operated with one hand, that is, the blade holder 30 guided on both sides can easily be moved from its securing position into the working position and back. If the blade holder 30 is in its working position, the user can make any cuts. Here, the ergonomic shape of the handle 20 facilitates the comfortable use of the rotary cutter 10. Here, the upper part 21 and the lower part 22 of the handle 20 are ergonomically shaped and made of a soft plastic material, which conveys a pleasant feel. The upper part 21 is slightly indented at the transition between the grip area 23 and the holding area 24 and offers a surface for the thumb or forefinger in order to exert pressure when using the rotary cutter 10. The lower part 22 offers an ergonomically designed surface for the surrounding fingers. Upper part 21 and lower part 22 are connected to one another in this rotary cutter 10, so that the user's entire hand also rests on soft plastic on the right side of the rotary cutter 10. The rotary cutter 10 can be used in various hand positions and can be guided in the separating cuts. In the separating cuts, the blade edge 331 of the blade 33 is always clearly visible. After a separating cut, the securing position can easily be reset to prevent injuries to the user or damage to the textile materials used.

REFERENCE LIST

10 rotary cutter
20 handle
21 upper part
22 lower part
23 handle part
231 recess
232 central groove
24 holding area
241 rear wall
242 hole
25 shell
26 shell
27 semicircular guide
271 narrowing
28 cover
29 semicircular guide
291 narrowing
30, 30', 30", 30'" blade holder
31, 31' rotary knob

32 bearing bushing
33 blade
331 blade edge
34 slide bearings
35 cylinders
36, 37 sidewall of 30
38 outer wall of 30
40 metal screw
41 hexagon socket driving profile
42 threaded shaft
50 screw head drive tool
51 hexagonal shaft
52 tool head
53 fixing element
60 plug-in containers
D axis of rotation

The invention claimed is:

1. A rotary cutter with an interchangeable blade (33), the rotary cutter comprising:

a handle (20) and a blade holder (30) which is detachably connected to the handle (20) at one end of the handle (20), the handle defining a holding area (24), the blade holder (30) supporting the blade (33) with a circumferential blade edge (331), the blade being rotatable about an axis of rotation (D), characterized in that, a fixed sheath of the blade holder (30) takes up at least half of the blade (33), thereby covering the blade (33) on both sides thereof through side walls (36, 37) of the sheath semicircularly, and the blade edge (331) for at least half of its circumference protected by an outer wall (38) of the sheath, the outer wall (38) connecting with the side walls (36, 37) of the sheath, and the shape of the outer wall is adapted to the circumference of the blade;

a bearing bushing (32) is provided for rotatable mounting of the blade (33) on the side walls (36, 37) of the sheath in the area around the axis of rotation (D), and the blade (33) has a slide bearing (34);

the blade holder (30) is arranged rotatably about the axis of rotation (D) on the handle (20), two rotational end positions being provided, namely a first rotational end position, defining a securing position, where the blade (33) protruding from the handle (20) is covered, and a second rotational end position, defining a working position, where the blade (33) protruding from the handle (20) is exposed; and a rotary knob (31) protrudes from a rear side wall (37) of the blade holder (30) and this rotary knob (31) engages a semicircular guide (27) on a rear wall (241) of the handle (20) and within the guide (27) the rotary knob (31) is movable between two end points, the two end points be two rotary end positions.

2. The rotary cutter according to claim 1, characterized in that in the holding area (24) of the handle (20) there is a cover (28) so that the blade holder (30) is arranged between the rear wall (241) of the handle (20) and the cover (28).

3. The rotary cutter according to claim 2, characterized in that the cover (28) has a semicircular guide (29) about the axis of rotation (D) at the same distance as the semicircular guide (27) on the rear wall (241) of the handle (20) is arranged, and is of the same size as the semicircular guide (27) on the rear wall (241) of the handle (20).

4. The rotary cutter according to claim 3, characterized in that a further rotary knob (31') protrudes from a front side wall (36) of the blade holder (30), and this further rotary knob (31') engages in the semicircular guide (29) of the cover (28).

5. The rotary cutter according to claim 2, characterized in that the detachable connection between the holding area (24) of the handle (20) and the blade holder (30) is a screw connection comprising a screw (40) extending along the axis of rotation (D) and passing through a hole (242) of the rear wall (241) in the holding area (24) of the handle (20), the bearing bushings (32) of the sheath and the slide bearing (34) of the blade (33).

6. The rotary cutter according to claim 5, characterized in that a thread (42) is provided at one end of the shaft of the screw (40), which cooperates with a separate nut or with a threaded sleeve on the inside of the cover (28).

7. The rotary cutter according to claim 5, characterized in that the screw (40) has a driving profile (41) on the screw head of the screw.

8. The rotary cutter according to claim 7, characterized in that the driving profile (41) on the screw head is a hexagon socket.

9. The rotary cutter according to claim 1, characterized in that in the securing position, the blade holder (30) protrudes from the holding area (24) of the handle (20) and the blade (33) is arranged within the blade holder (30) and the handle (20).

10. The rotary cutter according to claim 1, characterized in that the semicircular guide (27) of the handle (20) is adapted in width to the diameter of the rotary knob (31), and that the two rotary end positions for the rotary knob (31, 31') are brought about by narrowing (271) of the guide width.

11. The rotary cutter according to claim 1, characterized in that by loosening the connection between the handle (20) and the blade holder (30), the blade (33) supported on the blade holder (30) can be removed as a unit from the handle (20).

12. The rotary cutter according to claim 1, characterized in that a recess (231) is provided on a handle part (23) of the handle (20).

13. The rotary cutter according to claim 12, characterized in that the recess (231) runs through the handle (20) and can accommodate a tool (50).

14. The rotary cutter according to claim 13, characterized in that the tool (50) is a screw head drive and has a screw shaft (51) with a hexagonal cross section and a tool head (52) adapted to the recess (231) of the handle (20).

15. The rotary cutter according to claim 13, characterized in that in the recess (231) of the handle (20) there is additionally at least one fixing element for the tool (50), the fixing element being a groove or rib between the shells (25, 26).

16. The rotary cutter according to claim 15, characterized in that the tool head (52) on the tool (50) has at least one fixing element (53) which interacts with the fixing element in the recess (231) of the handle (20).

17. The rotary cutter according to claim 1, characterized in that the handle (20) comprises two composite shells (25, 26) made of plastic and has an ergonomically designed upper part (21) and an ergonomically designed lower part (22).

18. The rotary cutter according to claim 17, characterized in that the upper part (21) and the lower part (22) consist of a plastic softer than the two composite shells (25, 26).

19. The rotary cutter according to claim 18, characterized in that the upper part (21) and the lower part (22) of the handles (20) are different in color from the shells (25, 26).

20. A roll cutting set comprising a rotary cutter (10) according to claim 1 and several units each consisting of a blade holder (30) and a blade (33).

21. The roll cutting set according to claim 20, characterized in that the blades (33) of the several units each have the same diameter but a different profile of a circumferential blade edge (331).

22. The roll cutting set according to claim 20, characterized in that in the several units the blade holders (30, 30', 30", 30'") for their respective blades (33) are designed in different colors.

23. The roll cutting set according to claim 20, characterized in that an insert container (60) is provided for storing the blade holders (30', 30", 30'") of the several units that are not used in the rotary cutter (10) such that a respective blade (33) of each stored blade holder is protected by the container.

* * * * *